US006492955B1

(12) United States Patent
Amyotte et al.

(10) Patent No.: US 6,492,955 B1
(45) Date of Patent: Dec. 10, 2002

(54) STEERABLE ANTENNA SYSTEM WITH FIXED FEED SOURCE

(75) Inventors: Eric Amyotte, Laval (CA); Martin Gimersky, Montreal (CA); Jean-Daniel Richerd, Montreal (CA)

(73) Assignee: EMS Technologies Canada, Ltd., Ste-Anne-de-Bellevue (CA)

( * ) Notice: Subject to any disclaimer, the term of this patent is extended or adjusted under 35 U.S.C. 154(b) by 0 days.

(21) Appl. No.: 09/967,949

(22) Filed: Oct. 2, 2001

(51) Int. Cl.[7] ..... H01Q 13/00; H01Q 19/10

(52) U.S. Cl. ..... 343/781 P; 343/755; 343/757; 343/840; 343/765

(58) Field of Search ..... 343/705, 755, 343/757, 765, 766, 878, 840, 882, 781 P; 342/352, 356

(56) References Cited

U.S. PATENT DOCUMENTS

| | | | | |
|---|---|---|---|---|
| 3,848,255 A | | 11/1974 | Migdal | |
| 4,425,566 A | | 1/1984 | Dragone | |
| 4,668,955 A | | 5/1987 | Smoll | |
| 4,772,892 A | | 9/1988 | Payelian et al. | |
| 5,198,827 A | | 3/1993 | Seaton | |
| 5,229,781 A | | 7/1993 | Losquadro et al. | |
| 5,485,168 A | * | 1/1996 | Parekh | 343/761 |
| 5,579,021 A | | 11/1996 | Lee | |
| 5,684,494 A | | 11/1997 | Nathrath et al. | |
| 5,844,527 A | * | 12/1998 | Takashima et al. | 343/781 CA |
| 6,043,788 A | | 3/2000 | Seavey | |
| 6,191,744 B1 | * | 2/2001 | Snow et al. | 342/360 |

* cited by examiner

*Primary Examiner*—Tan Ho
(74) *Attorney, Agent, or Firm*—Holland & Knight LLP

(57) ABSTRACT

A steerable antenna system for transmitting and/or receiving an electromagnetic signal to a relatively moving target includes a hyperbolic subreflector secured to a frame rotatably mounted on a support structure via a first motor and a feed source located at a first focus of the subreflector for illuminating the same. The source, fixed to the structure, has a source axis pointing at the subreflector. A parabolic reflector having a focus in common with the second focus of the subreflector to transfer the signal between the same and a planar reflector is secured to the frame and has a beam axis. The planar reflector having a normal axis intersecting the beam axis with an angle is rotatably mounted on the frame via a second motor to transfer the signal between the parabolic reflector and the target. The system may include a controller connected to the motors to control the system to steer at the target anywhere within a full spherical angular range.

19 Claims, 4 Drawing Sheets

STEERABLE ANTENNA SYSTEM WITH FIXED FEED SOURCE

FIELD OF THE INVENTION

The present invention relates to the field of antennas and is more particularly concerned with steerable antenna systems for transmitting and/or receiving electromagnetic signals.

BACKGROUND OF THE INVENTION

It is well known in the art to use steerable (or tracking) antenna systems to communicate with a relatively moving target. Especially in the aerospace industry, such steerable antennas preferably need to have a high gain, low mass, and a high reliability. One way to achieve such an antenna system is to provide a fixed feed source, thereby eliminating performance degradations otherwise associated with a moving feed source. These degradations include losses due to mechanical rotary joints, RF cable connectors; flexible waveguides, long-length RF cables associated with cable wrap units mounted on rotary actuators or the like.

Also, such steerable/tracking antennas should be designed such as to avoid a so-called keyhole effect, which is a physical limitation due to the orientation of the antenna rotation axis and caused by a limited motion range of an actuator or the like. This effect forces the antenna to momentarily disrupt communication when reaching the physical limitation to allow for the actuators to reposition before resuming the steering, thereby seriously affecting the communication capabilities of the entire antenna system.

U.S. Pat. No. 6,043,788 granted on Mar. 28, 2000 to Seavey discloses tracking antenna system that is substantially robust and includes a large quantity of moving components that reduce the overall reliability of the system. Also, the steering angle range of the system is limited by the fixed angle between the boresite of the offset paraboloidal reflector and the kappa axis determined by the distance between the offset ellipsoidal subreflector and the offset paraboloidal reflector; a wide range requiring a large distance there between, resulting in a large antenna system that would not be practical especially for spaceborne applications.

OBJECTS OF THE INVENTION

It is therefore a general object of the present invention to provide a steerable antenna system with a fixed feed source that obviates the above-noted disadvantages.

Another object of the present invention is to provide a steerable antenna system with a fixed feed source that enables beam steering over a full spherical ($4\pi$ steradians) angular range with minimum blockage from its own structure, whenever allowed by the supporting platform.

A further object of the present invention is to provide a steerable antenna system with a fixed feed source that enables tracking of a remote station without any keyhole effect over any hemispherical coverage ($2\pi$ steradians).

Yet another object of the present invention is to provide a steerable antenna system with a fixed feed source having a high gain, an excellent polarization purity and/or low sidelobes.

Still another object of the present invention is to provide a steerable antenna system with fixed feed source having simple actuation devices as well as locations of the same.

Another object of the present invention is to provide a fixed-feed source steerable antenna system that can be so positioned with a first actuator as to enable tracking of a same orbiting remote station using only a second actuator when the orbit passes in proximity to the zenith of the system location.

A further object of the present invention is to provide a fixed-feed source steerable antenna system that can be mounted on either an orbiting spacecraft or a fixed station and track a ground station or an orbiting spacecraft respectively, or be mounted on a spacecraft and track another spacecraft.

Other objects and advantages of the present invention will become apparent from a careful reading of the detailed description provided herein, within appropriate reference to the accompanying drawings.

SUMMARY OF THE INVENTION

According to the present invention, there is provided a steerable antenna system for transmitting and/or receiving an electromagnetic signal to/from a target relatively moving therearound, said system comprises:

- a hyperbolic subreflector secured to a frame rotatably mounted on a support structure;
- a feed source located at a first focus of the subreflector for transmitting and receiving the signal to and from the same respectively, the feed source being secured to the support structure and having a source axis pointing at the subreflector;
- a parabolic reflector having a focus in common with a second focus of the subreflector for transferring the signal from and to the same respectively; the parabolic reflector being secured to the frame and having a beam axis;
- a planar reflector having a normal axis intersecting the beam axis with a predetermined angle for transferring the signal from and to the parabolic reflector respectively, the planar reflector being rotatably mounted on the frame for transferring the signal to and from the target;
- a first rotating member rotating the frame about the source axis; and
- a second rotating member rotating the planar reflector about the beam axis, thereby having the system to steer at the target.

Preferably, the system includes a controller controlling rotation of the first and the second rotating members; thereby controlling the system to steer at the target.

Preferably, the first and the second rotating members allow for the antenna system to steer at the target anywhere within a full spherical angular range.

Preferably, the source axis and the beam axis are co-planar, thereby defining an antenna plane rotating about the source axis.

Preferably, the beam axis is perpendicular to the source axis.

Preferably, the planar reflector is of a generally elliptical shape to provide circular projections along the beam axis and a direction of the target.

Preferably, the predetermined angle is a 45-degree angle, thereby reflecting the signal from the parabolic reflector within a signal plane perpendicular to the beam axis.

Preferably, the feed source including a horn and the support structure are mounted on a generally planar platform substantially parallel to the source axis.

Alternatively, the feed source including a horn and the support structure are mounted on a generally planar platform substantially perpendicular to the source axis.

Preferably, the controller includes a first and a second encoders mounted on the first and the second rotating members respectively for providing feedback of a position of the respective rotating member to the controller.

Preferably, the feed source is a dual frequency dual circular polarization feed source.

Preferably, the controller simultaneously drives the first and the second rotating members to have the antenna system steering in a desired direction.

Preferably, the controller provides commands to the first and the second rotating members that automatically steer at the moving target.

Preferably, the first and the second rotating members are a first and a second stepper motors respectively.

Preferably, the frame minimizes blockage and interference of the signal.

Preferably, the support structure is mounted on a spacecraft planet facing panel and the target is a ground station, the spacecraft orbiting around a planet.

Alternatively, the support structure and the target are mounted on a first and a second spacecraft respectively, the first and the second spacecraft orbiting around a same planet.

Alternatively, the support structure is mounted on a ground station and the target is an orbiting spacecraft.

BRIEF DESCRIPTION OF THE DRAWINGS

In the annexed drawings, like reference characters indicate like elements throughout.

FIG. 4 is a schematic perspective illustration showing the steering motion of the embodiment of FIG. 1 under activation of both actuator members for steering at relatively moving target such as an orbiting spacecraft or the like.

DETAILED DESCRIPTION OF THE PREFERRED EMBODIMENTS

With reference to the annexed drawings the preferred embodiments of the present invention will be herein described for indicative purpose and by no means as of limitation.

Figure 1:
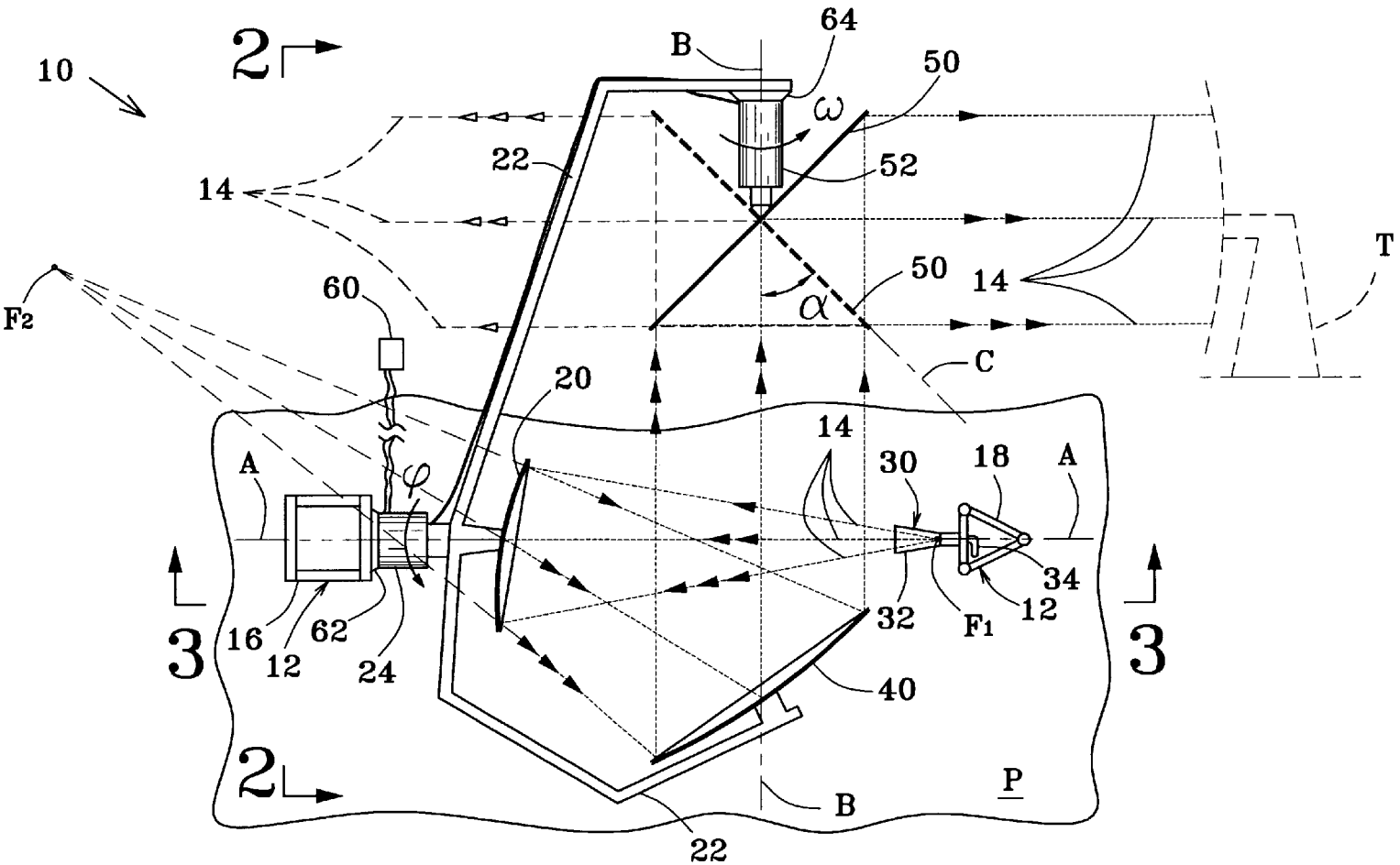
FIG. 1 is a plan view of an embodiment of a steerable antenna system with a fixed feed source according to the present invention mounted on a support structure with the feed source axis parallel to the same, elevation and cross-elevation angles of zero and 180° respectively.
Figure 2:
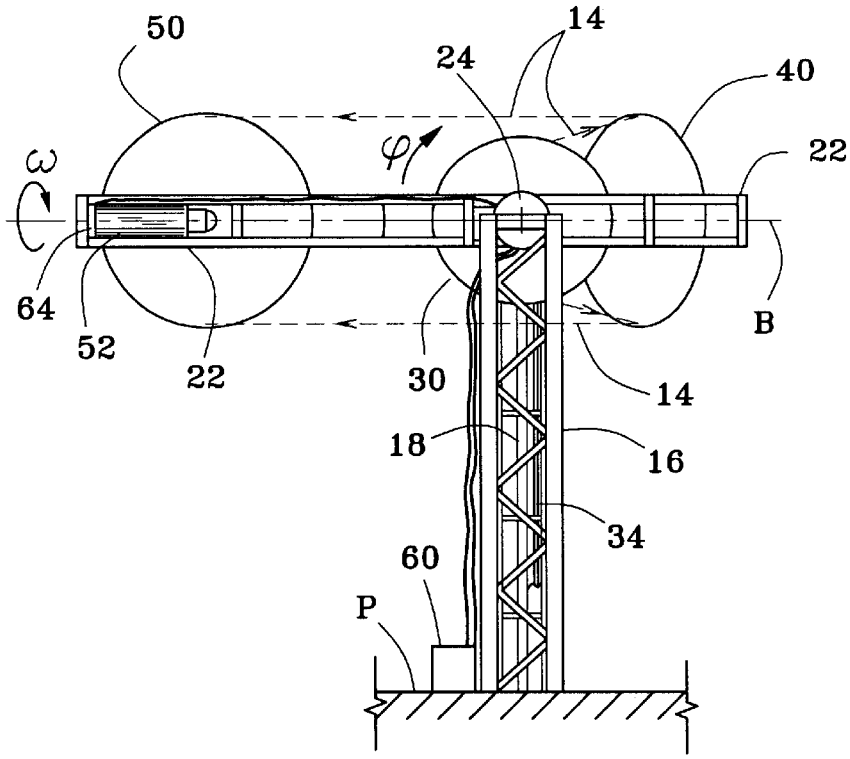
FIG. 2 is a side view taken along line 2—2 of FIG. 1.
Figure 3:
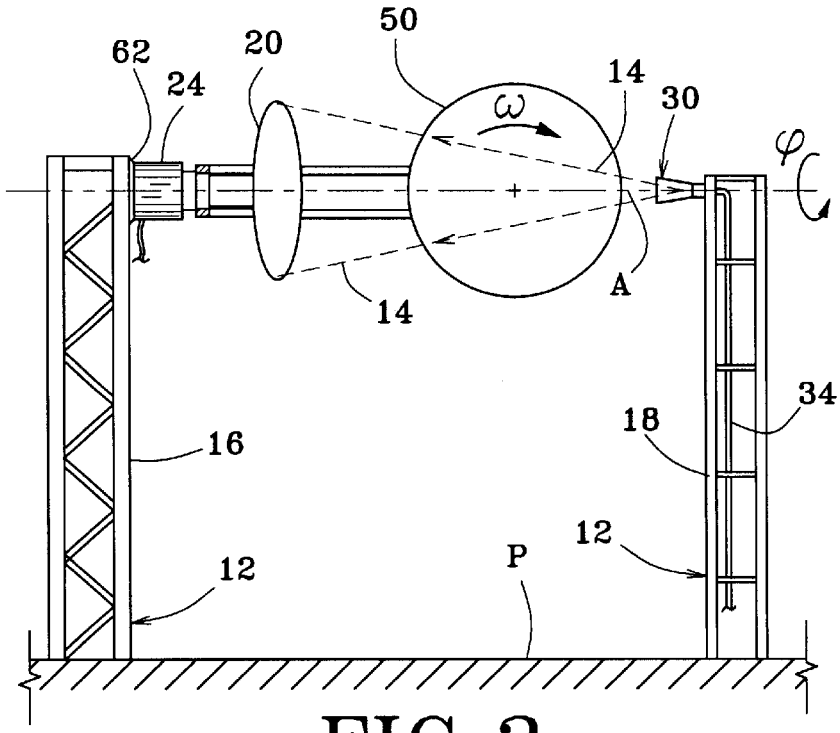
FIG. 3 is a side view taken along line 3—3 of FIG. 1.

Referring to FIGS. 1 to 3, there is shown an embodiment 10 of a steerable antenna system with a fixed feed source according to the present invention mounted on a support structure 12 for transmitting and/or receiving an electromagnetic signal 14 to and/or from a target T relatively moving or orbiting around the same. The antenna system 10 includes a fixed RF (Radio Frequency) or the like feed source 30, preferably including a horn 32 connected to a conventional waveguide 34 or the like, secured to the support structure 12 and having a source axis A pointing at a hyperbolic subreflector 20 secured to a frame member 22 that is rotatably mounted on the structure 12, preferably secured to a planar platform P. The generally C-shaped frame 22 also supports a parabolic reflector 40 and a flat reflector 50, rigidly and rotatably mounted thereon, respectively.

The subreflector 20 is so oriented as to have its first F1 and second F2 focal points (or focus) in common with the focal point of the feed source 30 and the parabolic reflector 40, respectively. The latter is so oriented as to reflect (or transfer) the signal 14 received from the subreflector 20 to the flat reflector 50 along a beam axis B and vice-versa. Preferably, the feed source 30, subreflector 20, parabolic reflector 40 and flat reflector 50 all lie within a same antenna plane or elevation plane E. Accordingly, the source A and beam B axes are co-planar, and preferably perpendicular to each other, for the antenna system 10 to be as compact as possible.

A first rotating member 24, preferably a first rotating actuator such as a stepper motor or the like, mounted on the structure 12 rotates the frame 22 along with the subreflector 20, the parabolic 40 and flat 50 reflectors about the source axis A. A second rotating member 52, preferably a second rotating stepper motor actuator, mounted on the frame 22 rotates the flat reflector 50 preferably about the beam axis B; as illustrated in FIG. 1 with the flat reflector 50 shown in solid and dashed lines to reflect the signal 14 to the right and left hand side, respectively. The flat reflector 50 is preferably elliptic in shape in order to provide a circular projected aperture along the beam axis B and the direction of the target T, in these two positions.

A controller member 60 is preferably connected to the motors 24, 52 via a first 62 and a second 64 encoders (or the like) respectively to control the rotation of the same; thereby controlling the system antenna 10 to steer at the target T, preferably anywhere within a full spherical angular range.

The normal axis C of the flat reflector 50 preferably makes a forty-five degree (45°) constant angle a relative to the beam axis B to reflect the signal 14 coming from the parabolic reflector 40 within a signal plane or cross-elevation (x-elevation) plane X perpendicular to the elevation plane E and parallel to the source axis A. Consequently, the projection of the flat reflector 50 perpendicular to both the output signal 14 direction and the beam axis B is circular as shown in FIGS. 2 and 3, respectively.

Accordingly, the first 24 and second 52 motors are the elevation and x-elevation motors adjusting the reference elevation angle $\psi$ and x-elevation angle $\omega$ of the antenna system 10 respectively. Similarly, the source A and beam B axes are the elevation and x-elevation axes respectively.

Although the antenna system 10 can steer in the $4\pi$ steradian full spherical angular range ($\psi$=0° to 360°; $\omega$=0° to 360°), it preferably operates over a half spherical angular range ($\psi$=0° to 180°; $\omega$=0° to 360°) above the platform P since the latter is obviously generally solid and opaque to RF signals. Only the portion of the frame 22 extending to support the flat reflector 50 provides small or negligible blockage and interference that might affect the antenna output signal or antenna gain when the flat reflector 50 is oriented toward the same (over a small x-elevation angle range of $\omega$=0° to ±20° approximately), depending on its actual geometry and the frequency of the signal 14.

Since the source axis A is parallel to the platform P, both the elevation motor 24 and the horn 32 are mounted on respective brackets 16, 18 of the structure 12 to allow for the frame 22 to clear the same during its rotational displacement about the source axis A, as seen in FIGS. 2 and 3. Furthermore, the actual shapes of the horn 32, subreflector 20, parabolic reflector 40 and flat reflector 50 are determined to maximize the overall electrical antenna gain as it would be obvious to anyone having ordinary skill in the art, also considering its performance in all other aspects such as mechanical, power, reliability, cost, manufacturability, etc.

Preferably, the feed source 30 is a dual frequency dual circular polarization feed source or any other suitable electromagnetic signal source.

In a preferred embodiment of the antenna system 10 of the present invention, the platform P represents a spacecraft Earth facing panel and the target T is a ground station on the Earth surface; the spacecraft orbiting around the Earth (or any other planet or the like). Alternatively, the antenna system 10 could be a ground station steering at an orbiting spacecraft to transmit and/or receive signal to/from the same.

The antenna system 10 of the present invention mounted on an orbiting spacecraft can also be used to communicate with a similar antenna system 10 mounted on another orbiting spacecraft, whereby the two antenna systems 10 would continuously steer at each other while the two spacecraft are moving in their respective orbits.

Obviously, the controller member 60 can simultaneously drive the two motors 24, 52 to have the antenna system 10 sequentially and continuously steering at a moving target in any desired direction.

Figure 4:
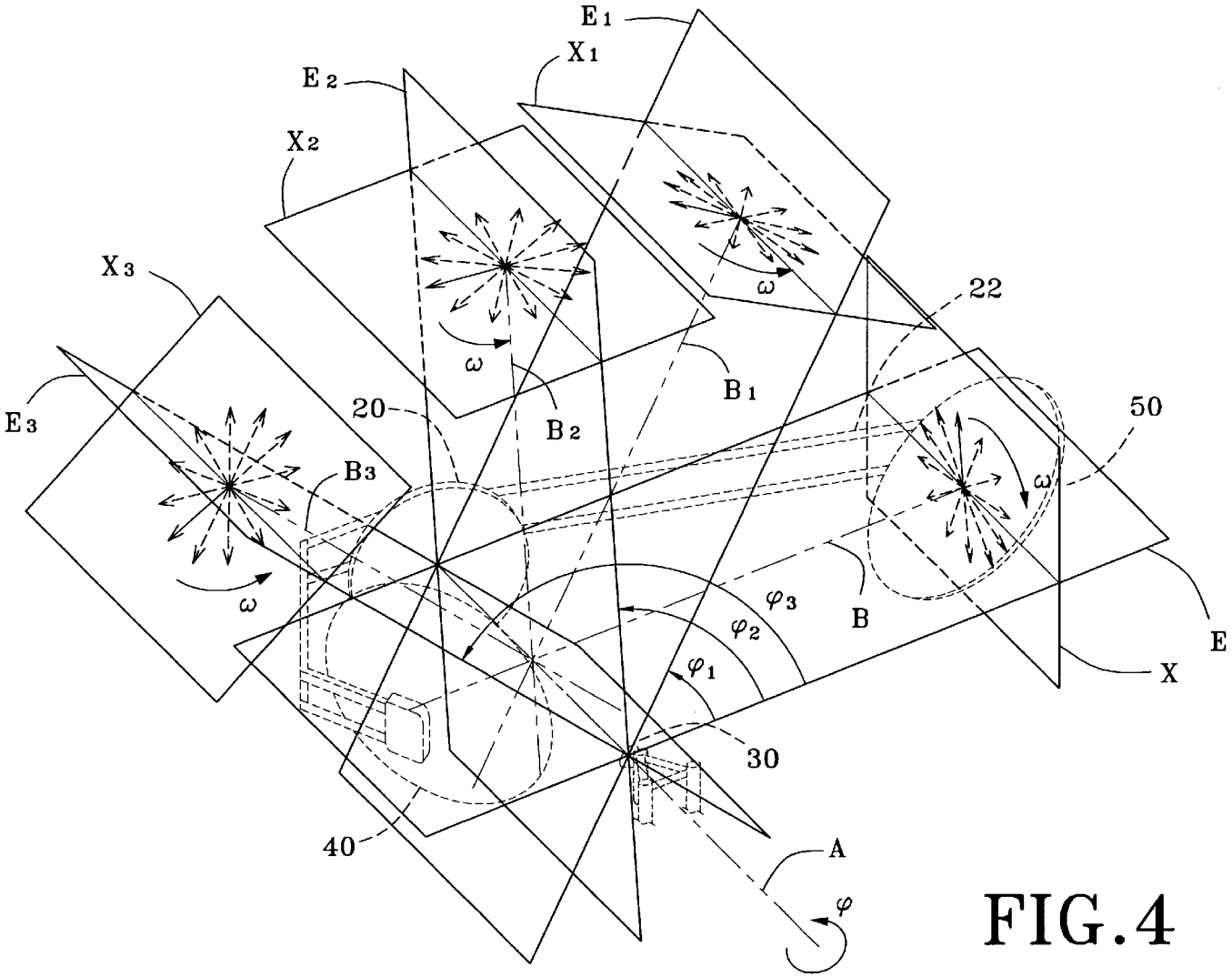

Referring to FIG. 4, there is shown a schematic perspective sequential illustration of the steering coverage of the antenna system 10 (shown in dashed lines) of the present invention with the rotational displacement $\omega$ of the output signal 14 (shown by all the coplanar arrows in dashed lines) about the x-elevation axis B to form the x-elevation plane X, and the rotational displacement $\psi$ of both elevation E and x-elevation X planes about the elevation axis A to substantially cover the full spherical angle around the antenna system 10. The motion being represented in FIG. 4 by three different displacements of the elevation $E_1$, $E_2$, $E_3$ and x-elevation $X_1$, $X_2$, $X_3$ planes by the corresponding respective rotation angles $\psi_1$, $\psi_2$, $\psi_3$ about the source axis A.

When the antenna system 10 has to track a moving target T for a short period of time over a relatively small angular range, it is possible for the controller 60 to properly position the antenna system 10 using the elevation motor 24 such that only the x-elevation motor 52 is used for the tracking itself of the target T, considering that the path of the target T essentially remains within a same plane, the x-elevation plane X, as seen by the antenna system 10.

Figure 5:
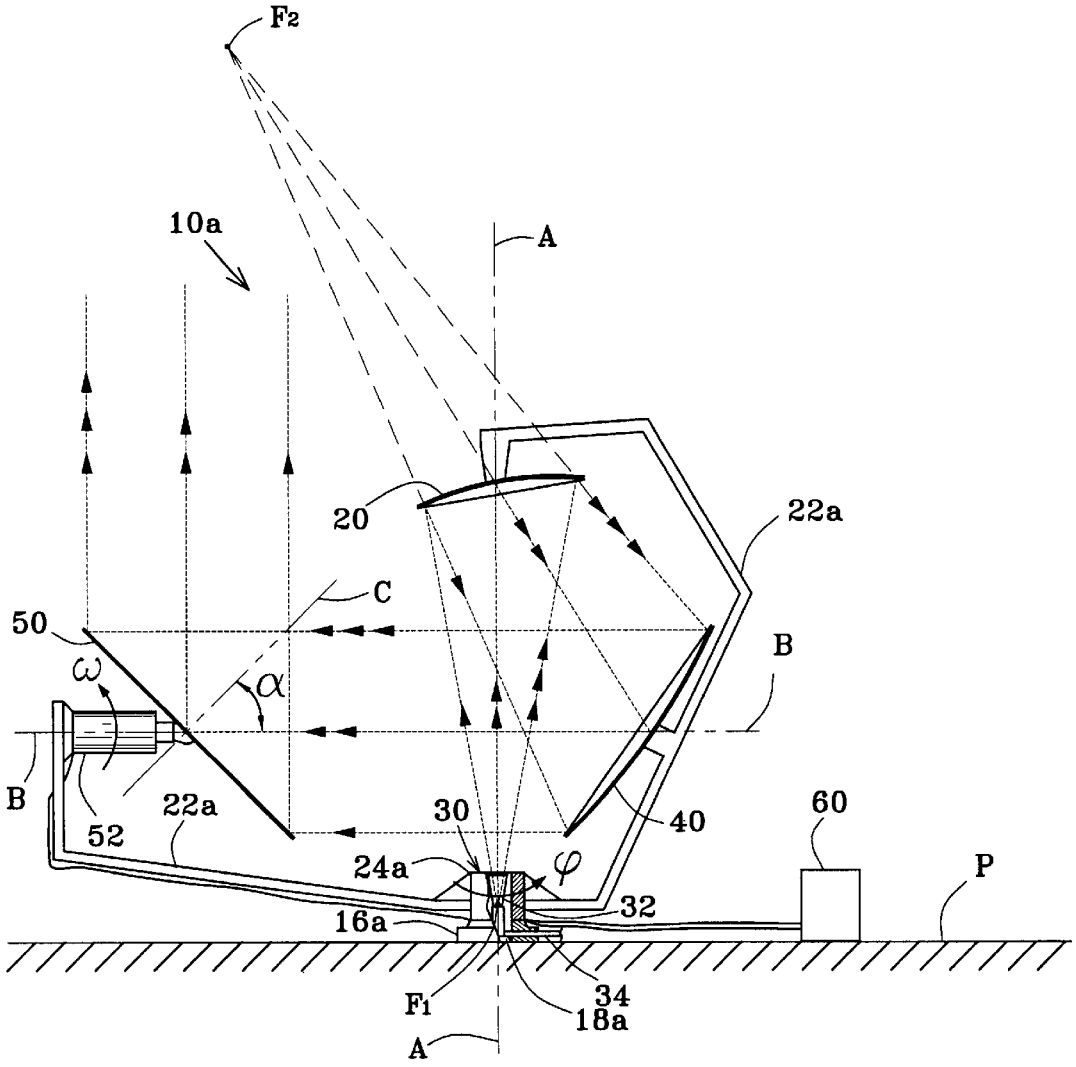
FIG. 5 is a partially sectioned side view of a second embodiment of a steerable antenna system with a fixed feed source according to the present invention, showing the system mounted on a support structure with the feed source axis perpendicular to the same.

Referring to FIG. 5, there is shown a second embodiment 10*a* of the antenna system positioned with the elevation source axis A essentially perpendicular to the platform P. In this case, the bracket 18*a* is substantially reduced down to a simple mounting bracket connected to the horn 32 that points upward at the subreflector 20, thus limiting the run of the waveguide 34 connecting thereto, and the signal losses associated therewith. The bracket 16*a* is also reduced down to a simple support for the elevation, motor 24*a* itself supporting the rotating frame 22*a*. The elevation motor 24*a* is preferably hollowed to enable the fixed horn 32 to be centered and point at the subreflector 20 without being affected by the rotation induced by the same 24*a* to the frame 22*a*.

Although the steerable antenna system has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A steerable antenna system for transmitting and/or receiving an electromagnetic signal to/from a target relatively moving therearound, said system comprising:

a hyperbolic subreflector secured to a frame rotatably mounted on a support structure;

a feed source located at a first focus of the subreflector for transmitting and receiving the signal to and from the same respectively, the feed source being secured to the support structure and having a source axis pointing at the subreflector;

a parabolic reflector having a focus in common with a second focus of the subreflector for transferring the signal from and to the same respectively; the parabolic reflector being secured to the frame and having a beam axis;

a planar reflector having a normal axis intersecting the beam axis with a predetermined angle for transferring the signal from and to the parabolic reflector respectively, the planar reflector being rotatably mounted on the frame for transferring the signal to and from the target;

a first rotating member rotating the frame about the source axis; and a second rotating member rotating the planar reflector about the beam axis, thereby having the system to steer at the target.

2. A system as defined in claim 1, including a controller controlling rotation of the first and the second rotating members; thereby controlling the system to steer at the target.

3. A system as defined in claim 2, wherein the controller including a first and second encoders mounted on the first and the second rotating members respectively for providing feedback of a position of the respective rotating member to the controller.

4. A system as defined in claim 2, wherein the controller simultaneously driving the first and the second rotating member to have the antenna system steering in a desired direction.

5. A system as defined in claim 4, wherein the controller providing commands to the first and the second rotating members that automatically steer at the moving target.

6. A system as defined in claim 1, wherein the first and the second rotating members allow for the antenna system to steer at the target anywhere within a full spherical angular range.

7. A system as defined in claim 1, wherein the source axis and the beam axis being co-planar, thereby defining an antenna plane rotating about the source axis.

8. A system as defined in claim 7, wherein the beam axis being perpendicular to the source axis.

9. A system as defined in claim 8, wherein the planar reflector being of a generally elliptical shape to provide circular projections along the beam axis and a direction of the target.

10. A system as defined in claim 8, wherein the predetermined angle being a 45-degree angle, thereby reflecting the signal from the parabolic reflector within a signal plane perpendicular to the beam axis.

11. A system as defined in claim 10, wherein the feed source including a horn and the support structure being mounted on a generally planar platform substantially parallel to the source axis.

12. A system as defined in claim 10, wherein the feed source including a horn and the support structure being mounted on a generally planar platform substantially perpendicular to the source axis.

13. A system defined in claim 1, wherein the feed source being a dual frequency dual circular polarization feed source.

14. A system as defined in claim 1, wherein the first and the second rotating members being a first and a second rotating actuators respectively.

15. A system as defined in claim 14, wherein the first and the second rotating actuators being a first and a second stepper-motors respectively.

16. A system as defined in claim 1, wherein the frame minimizing blockage and interference of the signal.

17. A system as defined in claim 1, wherein the support structure being mounted on a spacecraft planet facing panel and the target being a ground station, the spacecraft orbiting around a planet.

18. A system as defined in claim 1, wherein the support structure and the target being mounted on a first and a second spacecraft respectively, the first and the second spacecraft orbiting around a same planet.

19. A system as defined in claim 1, wherein the support structure being mounted on a ground station and the target being an orbiting spacecraft.

* * * * *